US011130343B2

(12) United States Patent
Bannai et al.

(10) Patent No.: US 11,130,343 B2
(45) **Date of Patent: *Sep. 28, 2021**

(54) WIPING DEVICE, LIQUID DISCHARGING DEVICE, AND WIPING METHOD

(71) Applicant: RICOH COMPANY, LTD., Tokyo (JP)

(72) Inventors: Akiko Bannai, Kanagawa (JP); Takumi Atake, Kanagawa (JP); Yohta Sakon, Kanagawa (JP); Hiroko Ohkura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 43 days.

This patent is subject to a terminal disclaimer.

(21) Appl. No.: 16/695,339

(22) Filed: Nov. 26, 2019

(65) Prior Publication Data

US 2020/0164650 A1 May 28, 2020

(30) Foreign Application Priority Data

Nov. 28, 2018 (JP) ..... JP2018-222048

(51) Int. Cl.
*B41J 2/165* (2006.01)

(52) U.S. Cl.
CPC ..... *B41J 2/16544* (2013.01); *B41J 2/16552* (2013.01); *B41J 2002/16558* (2013.01)

(58) Field of Classification Search
CPC ... B41J 2/01; B41J 2/211; B41J 2/1433; B41J 2/17; B41J 2/17593; B41J 2/2107;
(Continued)

(56) References Cited

U.S. PATENT DOCUMENTS

2007/0057990 A1 3/2007 Yakura et al.
2013/0194345 A1* 8/2013 Tamai ..... B41J 2/20 347/22

(Continued)

FOREIGN PATENT DOCUMENTS

JP 4940917 B2 5/2012
JP 2014-188900 10/2014
JP 2018-069730 5/2018

OTHER PUBLICATIONS

U.S. Appl. No. 16/423,261, filed May 28, 2019 Hiroko Ohkura, et al.

(Continued)

*Primary Examiner* — Manish S Shah
(74) *Attorney, Agent, or Firm* — Grüneberg and Myers PLLC

(57) ABSTRACT

A wiping device includes a wiping member configured to wipe a nozzle forming surface of a liquid discharging head that discharges a liquid from a nozzle, the wiping member having a first layer configured to be brought into contact with the nozzle forming surface and at least one more layer, and a cleaning liquid that is applied to the nozzle forming surface, the cleaning liquid containing a compound represented by the following Chemical formula 1 and a glycol ether compound, Chemical formula 1

(Continued)

where $R^1$ represents an alkyl group having one to four carbon atoms.

12 Claims, 3 Drawing Sheets

(58) Field of Classification Search
CPC ..... B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 2/1623; B41J 2202/00; B41J 2202/03; B41J 2/045; B41J 11/0015; B41J 11/002; B41J 2/04581; B41J 2/055; B41J 2/16538; B41J 2/14201; B41J 2002/16502; B41J 29/02; B41J 2/17513; B41J 2/17509; B41J 29/13; B41J 2/17553; B41J 2/1606; B41J 2/1642; B41J 2/1609; B41J 2/164; B41J 2/162; B41J 2/161; B41J 2/19; B41J 15/04; B41J 25/001; B41J 25/34; B41J 25/003; B41J 25/312; B41J 2025/008; B41J 2202/21; B41J 2/17596; B41J 2/16508; B41J 2/1652; B41J 2/175; B41J 2/17563; B41J 2/16544; B41J 2/16552; B41J 2002/1655; B41J 2002/16558; B41J 2/16535; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52; C09D 11/106; B41M 5/0011; B41M 5/0017; B41M 5/0023; B41M 5/0047; B41M 7/00; B41M 7/0072; B41M 5/52; B41M 5/5218; B41M 5/5227
See application file for complete search history.

(56) References Cited

U.S. PATENT DOCUMENTS

| | | | | |
|---|---|---|---|---|
| 2014/0085376 | A1* | 3/2014 | Kato | B41J 2/17509 347/33 |
| 2017/0017194 | A1* | 1/2017 | Toyama | G03G 21/0017 |
| 2017/0120600 | A1 | 5/2017 | Yamanobe et al. | |
| 2017/0183528 | A1 | 6/2017 | Kohzuki et al. | |
| 2017/0267879 | A1* | 9/2017 | Kohzuki | B41J 2/16535 |
| 2018/0170061 | A1 | 6/2018 | Nakamura et al. | |
| 2018/0208783 | A1* | 7/2018 | Takahashi | B41J 2/1752 |
| 2019/0270903 | A1 | 9/2019 | Shizuka et al. | |

OTHER PUBLICATIONS

Extended European Search Report dated Apr. 6, 2020, in Patent Application No. 19211211.8, 7 pages.

* cited by examiner

WIPING DEVICE, LIQUID DISCHARGING DEVICE, AND WIPING METHOD

CROSS-REFERENCE TO RELATED APPLICATIONS

This patent application is based on and claims priority pursuant to 35 U.S.C. § 119 to Japanese Patent Application No. 2018-222048, filed on Nov. 28, 2018 in the Japan Patent Office, the entire disclosure of which is hereby incorporated by reference herein.

BACKGROUND

Technical Field

The present disclosure relates to a wiping device, a liquid discharging device, and a wiping method.

Description of the Related Art

In a liquid discharging device represented by an inkjet printer, foreign matter on a nozzle forming surface causes a problem such as defective discharging. Therefore, the nozzle forming surface requires regular cleaning. A cleaning method using a wiping member for cleaning a nozzle forming surface formed by combining a sheet-shaped wiping member represented by non-woven fabric and woven fabric has been proposed.

SUMMARY

According to embodiments of the present disclosure, provided is a wiping device which includes a wiping member configured to wipe a nozzle forming surface of a liquid discharging head that discharges a liquid from a nozzle, the wiping member having a first layer configured to be brought into contact with the nozzle forming surface and at least one more layer, and a cleaning liquid that is applied to the nozzle forming surface, the cleaning liquid containing a compound represented by the following Chemical formula 1 and a glycol ether compound, Chemical formula 1

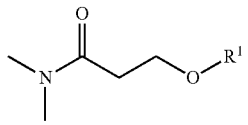

where $R^1$ represents an alkyl group having one to four carbon atoms.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

Figure 1:
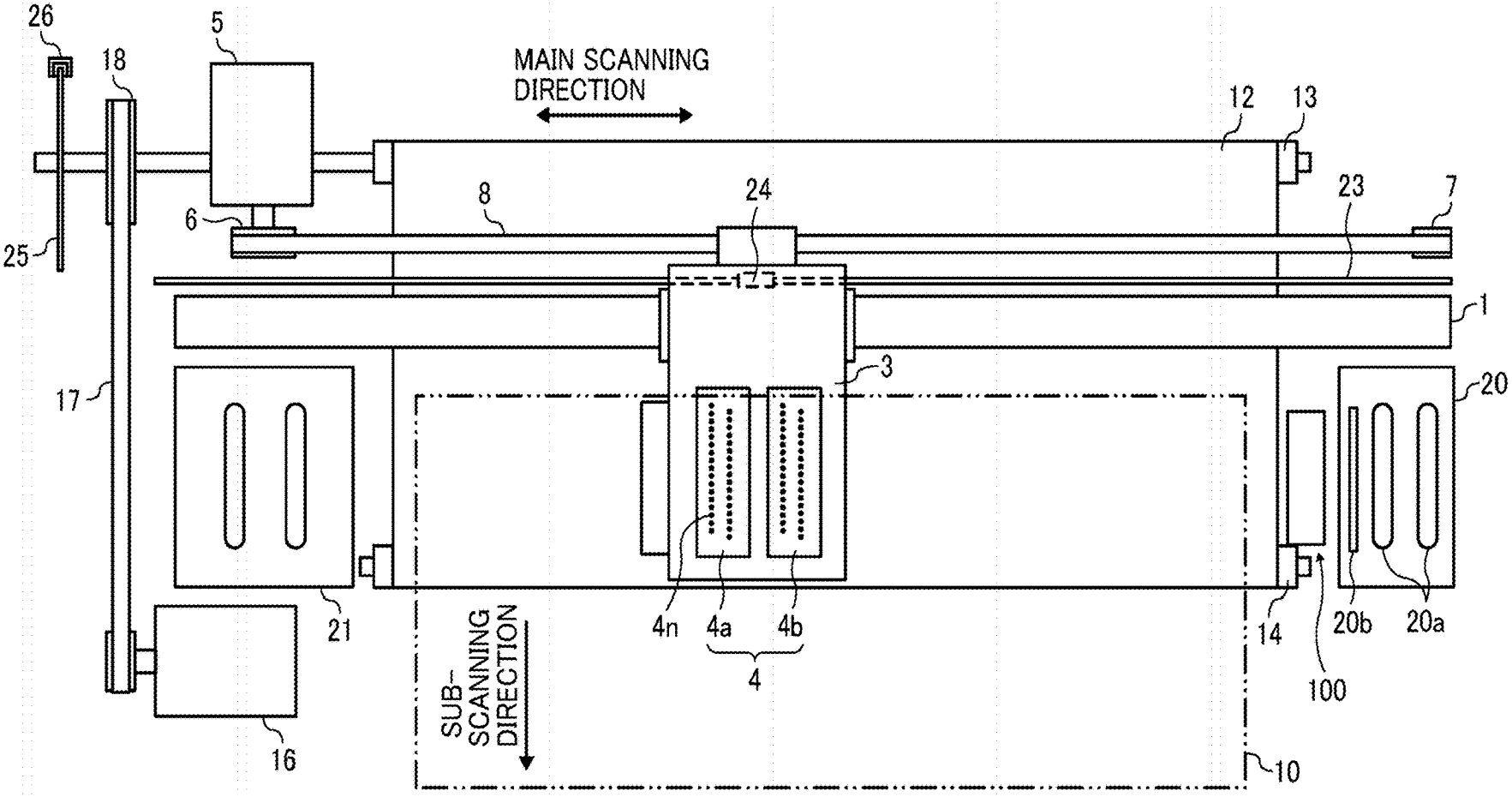
FIG. 1 is a schematic diagram illustrating an example of an image forming device incorporating a wiping device.

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF THE EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc., in the present disclosure represent the same meaning, unless otherwise specified.

Embodiments of the present invention are described in detail below with reference to accompanying drawing(s). In describing embodiments illustrated in the drawing(s), specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

A wiping device has been proposed in JP-2014-188900-A1 which relatively moves a liquid spraying head that sprays a liquid dispersion in which solid particles are dispersed in liquid against a wiping member to wipe off the liquid dispersion adhering to a nozzle forming surface. This wiping member has a first layer on the nozzle forming surface side and a second layer sandwiching the nozzle forming surface with the first layer. The first layer has a void that can guide liquid droplets as the dispersion medium of the liquid dispersion that adheres to the nozzle forming surface to the second layer due to the capillary action and can capture and contain the dispersoid of the liquid dispersion. The second layer absorbs the dispersion medium.

However, in the cleaning method using a typical wiping member, it is difficult to remove attached matter dried on a nozzle forming surface.

According to the present disclosure, provided is a wiping device capable of easily removing dried liquid matter adhering to a nozzle forming surface.

Aspects of the present disclosure are, for example, as follows:

1. A wiping device includes a wiping member configured to wipe a nozzle forming surface of a liquid discharging head that discharges a liquid from a nozzle, and a cleaning liquid that is applied to the nozzle forming surface, the cleaning liquid containing a compound represented by the following Chemical formula 1 and a glycol ether compound, wherein the wiping member has a first layer configured to be brought into contact with the nozzle forming surface and at least one more layer.

Chemical formula 1

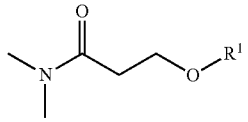

In Chemical formula 1, $R^1$ represents an alkyl group having one to four carbon atoms.

2. The wiping member according to 1 mentioned above, wherein the glycol ether compound is represented by the following Chemical formula 2, Chemical formula 2

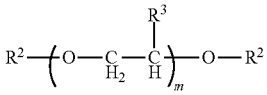

In Chemical formula 2, $R^2$ represents $C_nH_{2n+1}$ and $R^3$ represents a hydrogen atom or a methyl group. m represents an integer of from 1 to 4 and n represents an integer of from 1 to 4.

3. The wiping member according to 1 or 2 mentioned above, wherein the proportion of the glycol ether compound to the cleaning liquid is from 1.0 to 30.0 percent by mass.

4. The wiping member according to any one of 1 to 3 mentioned above, wherein the first layer has a porosity less than a porosity of at least one layer of the at least one more layer.

5. The wiping device according to any one of 1 to 4 mentioned above, wherein the porosity of the first layer is from 0.60 to 0.85.

6. The wiping device according to any one of 1 to 5 mentioned above further includes a cleaning liquid applying device that applies the cleaning liquid to the wiping member.

7. A liquid discharging device includes the wiping member according to any one of 1 to 6 mentioned above and the liquid discharging head.

8. The liquid discharging device according to 7 mentioned above, wherein the liquid contains a coloring material and an organic solvent.

9. The liquid discharging device according to 7 mentioned above, wherein the liquid contains a resin and no coloring material.

10. A wiping method includes applying a cleaning liquid to a nozzle forming surface of a liquid discharging head that discharges a liquid from a nozzle and wiping the nozzle forming surface with a wiping member, wherein the wiping member has at least two layers, wherein the cleaning liquid contains a compound represented by the following Chemical formula 1 and a glycol ether compound.

Chemical formula 1

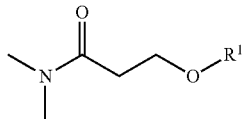

In Chemical formula 1, $R^1$ represents an alkyl group having one to four carbon atoms.

11. The wiping method according to 10 mentioned above, wherein the glycol ether compound is represented by the following Chemical formula 2.

Chemical formula 2

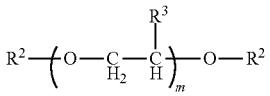

In Chemical formula 2, $R^2$ represents $C_nH_{2n+1}$ and $R^3$ represents a hydrogen atom or a methyl group. m represents an integer of from 1 to 4 and n represents an integer of from 1 to 4.

12. The wiping method according to 10 or 11 mentioned above, wherein the proportion of the glycol ether compound to the cleaning liquid is from 1.0 to 30.0 percent by mass.

Next, embodiments of the present disclosure are described.

Liquid Discharging Device, Wiping Device, and Wiping Method

The liquid discharging device according to an embodiment of the present disclosure includes a liquid discharging head that discharges liquid through a nozzle, a wiping device, and other optional devices (for example, devices relating to feeding, conveying, and ejecting a recording medium and devices referred to as a pre-processing device and a post-processing device). The wiping device includes a wiping member, a cleaning liquid, and other optional devices. Moreover, the wiping method executed by the liquid discharging device including a wiping device includes applying a cleaning liquid to a nozzle forming surface of a liquid discharging head that discharges liquid through a nozzle, wiping the nozzle forming surface, and other optional steps. The wiping device applies a cleaning liquid to a nozzle forming surface of a liquid discharging head that discharges liquid through a nozzle and brings the wiping member into contact with the nozzle forming surface to wipe the nozzle forming surface. In the present embodiment, wiping refers to relatively moving the wiping member against the liquid discharging head while bringing the wiping member and the nozzle forming surface into contact with each other. By wiping the nozzle forming surface using the wiping member, for example, it is possible to remove dried liquid matter adhering to the nozzle forming surface from the nozzle forming surface. In addition, for example, it is possible to prevent the liquid from drying and adhering to the nozzle forming surface by absorbing extra liquid overflowing from the nozzle.

Figure 2:
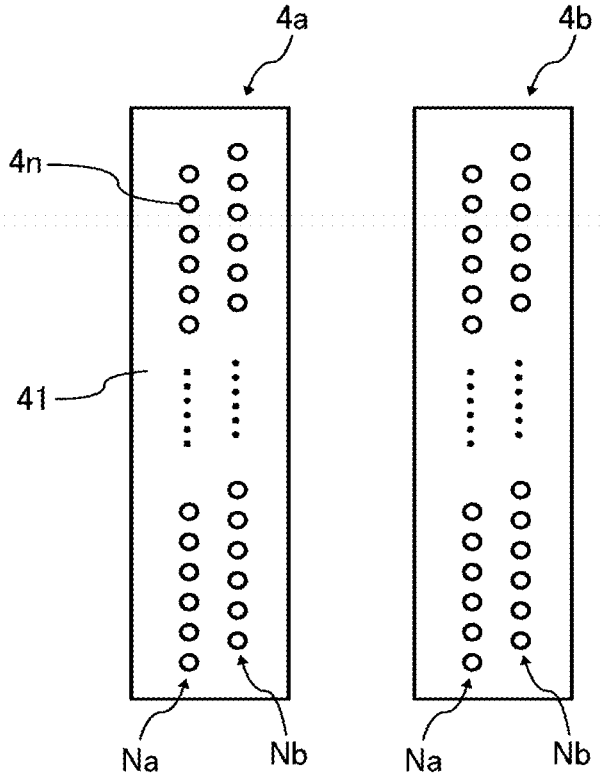
FIG. 2 is a schematic diagram illustrating an example of the nozzle forming surface of a liquid discharging head.
Figure 3:
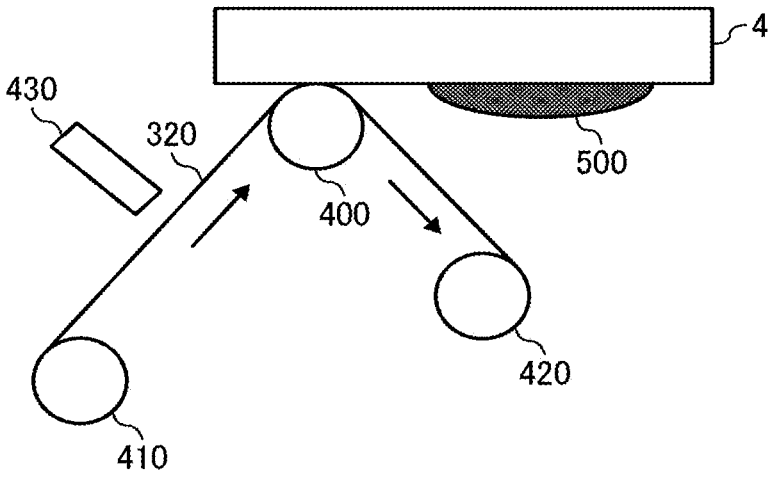
FIG. 3 is a schematic diagram illustrating an example of a wiping device.

First, with reference to FIGS. 1 to 3, the liquid discharging device and the wiping device are described taking as an example an image forming device (a printing device that executes a printing method described later), which is an example of the liquid discharging device incorporating a wiping device. The image forming device discharges ink as an example of the liquid and can be suitably installed in, for example, a printer/facsimile machine, a photocopier, a multifunction peripherals (serving as a printer, a facsimile machine, and a photocopier), and a solid freeform fabrication device (3D printer, additive manufacturing device, etc.). FIG. 1 is a schematic diagram illustrating an example of an image forming device incorporating a wiping device. FIG. 2 is a schematic diagram illustrating an example of the nozzle forming surface of a liquid discharging head. FIG. 3 is a schematic diagram illustrating an example of the wiping device.

The image forming device illustrated in FIG. 1 is a serial type liquid discharging device. The image forming device includes a carriage 3 which is movably held by a main guide member 1 and a sub-guide member, that are bridged between the left and right side plates. A main scanning motor 5 drives the carriage 3 to reciprocate in the main scanning direction (carriage moving direction) via a timing belt 8 stretched around a drive pully 6 and a driven pully 7. The carriage 3 carries recording heads 4*a* and 4*b* (referred to as recording head 4 if distinction thereof is not necessary) as examples of the liquid discharging heads. The recording head 4 discharges color ink droplets of, for example, yellow (Y), cyan (C), magenta (M), and black (K). The recording head 4 carries nozzle arrays, each having multiple nozzles 4*n* disposed along the sub-scanning direction vertical to the main scanning direction with the ink discharging surface downward.

As illustrated in FIG. 2, the recording head 4 includes two nozzle arrays Na and Nb, each including multiple nozzles 4*n* on a nozzle forming surface 41. As the liquid discharging head constituting the recording head 4, for example, it is possible to use a piezoelectric actuator such as a piezoelectric element and a thermal actuator that utilizes the phase change caused by film boiling of liquid by using an electric heat conversion element such as a heat element.

The image forming device illustrated in FIG. 1 has a conveyor belt 12 serving as a conveying device to convey a sheet 10 by electrostatic adsorption at the position facing the recording head 4. The conveyor belt 12 takes an endless form and stretched around a conveyor roller 13 and a tension roller 14. The conveyor belt 12 is moved around in the sub-scanning direction by the conveyor roller 13 rotationally driven by a sub-scanning motor 16 via a timing belt 17 and a timing pully 18. This conveyor belt 12 is charged (charges are applied) by a charging roller while circulating.

At one end in the main-scanning direction of the carriage 3, a maintenance and recovery assembly 20 configured to maintain and recover the recording head 4 is disposed lateral to the conveyor belt 12. On the other end, a dummy discharging receiver 21 configured to receive dummy discharge by the recording head 4 is disposed lateral to the conveyor belt 12. The maintenance and recovery assembly 20 includes, for example, a capping member 20*a* to cap the nozzle forming surface (surface on which the nozzle is formed) 41 of the recording head 4, a wiping assembly 20*b* that wipes the nozzle forming surface 41, and the dummy discharging receiver 21 that receives droplets not used for forming an image.

Further, the image forming device includes an encoder scale 23 that has a predetermined pattern and is stretched between both side plates along the main scanning direction of the carriage 3. Further, the carriage 3 includes an encoder sensor 24 formed of a transmission type photo sensor that reads the pattern of the encoder scale 23. These encoder scale 23 and the encoder sensor 24 constitute a linear encoder (main scanning encoder) to detect the movement of the carriage 3.

In addition, a code wheel 25 is mounted onto the shaft of the conveyor roller 13, and an encoder sensor 26 is provided which has a transmissive photosensor to detect the pattern formed on the code wheel 25. These code wheel 25 and encoder sensor 26 constitute a rotary encoder (sub-scanning encoder) to detect the moving and the position of the conveyor belt 12.

In the image forming device having such a configuration, the sheet 10 is fed onto the charged conveyor belt 12, adsorbed thereto, and conveyed along the sub-scanning direction in accordance with the rotation of the conveyor belt 12. By driving the recording head 4 in response to the image signal while moving the carriage 3 in the main-scanning direction, ink droplets are discharged onto the sheet 10 standing still to record an image in an amount of one line. After the sheet 10 is conveyed in a predetermined amount, the next line is recorded. On receiving a signal indicating that the recording is finished or the rear end of the sheet 10 has reached the image recording region, the recording operation stops, and the sheet 10 is ejected to an ejection tray.

In addition, the carriage 3 is moved in the printing (recording) standby mode to the maintenance and recovery assembly 20 to clean the recording head 4 by the maintenance and recovery assembly 20. Alternatively, the recording head 4 may not be moved and the maintenance and recovery assembly 20 may move to clean the recording head 4. The recording head 4 illustrated in FIG. 1 has two nozzle arrays Na and Nb, each including multiple nozzles 4*n*, as illustrated in FIG. 2. The nozzle array Na of the recording head 4*a* discharges black (K) liquid droplets and the other nozzle array Nb discharges cyan (C) liquid droplets. The nozzle array Na of the recording head 4*b* discharges magenta (M) liquid droplets and the other nozzle array Nb discharges yellow (Y) liquid droplets.

An example of the wiping device is the wiping assembly 20*b* that wipes the nozzle forming surface. As illustrated in FIG. 3, the wiping assembly 20*b* includes a sheet-like wiping member 320, which is an example of the wiping member, a delivery roller 410 that delivers the sheet-like wiping member 320, a cleaning liquid dropping device 430, which is an example of the cleaning liquid application device to apply a cleaning liquid to the sheet-like wiping member 320 delivered, a pressing roller 400 as an example of pressing the sheet-like wiping member 320 to which the cleaning liquid has been applied against the nozzle forming surface, and a reel-up roller 420 to collect the sheet-like wiping member 320 used for wiping. The cleaning liquid is supplied from a cleaning liquid storage container that stores the cleaning liquid through a cleaning liquid supply tube provided with a pump for supplying the cleaning liquid in the middle. In addition to the sheet-like wiping member 320, the wiping assembly 20*b* that wipes the nozzle surface may optionally include a rubber blade, etc., to wipe the nozzle forming surface. The pressing force of the pressing roller 400 can be adjusted by adjusting the distance between the cleaning unit and the nozzle forming surface by a spring. The pressing member is not limited to a roller but can be a fixed member made of plastic or rubber.

When the wiping assembly 20*b* includes a rubber blade, etc., an assembly of bringing the rubber blade, etc., into contact with the sheet-like wiping member 320 is provided to impart a cleaning ability of the rubber blade, etc., to the sheet-like wiping member 320. Moreover, although it is preferable that the sheet-like wiping member be held in a roll-up state as illustrated in FIG. 3 in terms of downsizing, the sheet-like wiping member is not limited thereto and may be folded. The cleaning liquid applying device is not limited to the cleaning liquid dropping device. For example, it includes a cleaning liquid applying roller for applying the cleaning liquid with a roller and a cleaning liquid applying spray for applying the cleaning liquid with a spray. Further, the cleaning liquid application executed by the cleaning liquid application device is not particularly limited as long as the cleaning liquid can be applied to the nozzle forming surface. In addition to the indirect cleaning liquid application via the cleaning liquid application device as in the embodiment described above, it is possible to directly apply the cleaning liquid to the nozzle forming surface. However, it is preferable to indirectly apply the cleaning liquid via a cleaning liquid applying device.

In the present embodiment, as an example of the wiping, after applying the cleaning liquid to the wiping member in a predetermined amount, the recording head 4 and the maintenance and recovery assembly 20 relatively move to each other while the wiping member is pressed against the nozzle forming surface 41 to wipe off foreign matter 500 adhering to the nozzle forming surface 41. Examples of the foreign matter 500 adhering to the nozzle forming surface 41 include, but are not limited to, mist ink produced during discharging of the ink from the nozzles 4*n*, ink adhering to the nozzle forming surface 41 when the ink is sucked from the nozzles 4*n* during, for example, cleaning, adhesion ink which is mist ink or ink adhering to the cap member dried on the nozzle forming surface 41, and paper dust produced from printed matter. In the present embodiment, the foreign matter 500 is wiped off after the cleaning liquid is applied to the wiping member that does not contain the cleaning liquid. However, a wiping member that contains the cleaning liquid in advance can be used instead of the cleaning liquid applying device. Moreover, the cleaning liquid can be applied to a portion other than the wiping member. For example, the cleaning liquid can be directly applied to the nozzle forming surface 41. That is, the cleaning liquid applied to the nozzle forming surface means all types of cleaning liquids applied to the nozzle forming surface. For example, it includes a cleaning liquid directly applied to the nozzle forming surface and a cleaning liquid indirectly applied to the nozzle forming surface via a wiping member containing the cleaning liquid. The latter is preferable to the former. Furthermore, if the ink is assumed to be dried and adhere to the nozzle forming surface as a result of a long standby period of time, etc., a configuration is preferable which wipes the nozzle forming surface multiple times with the wiping member containing the cleaning liquid to remove the dried ink. In addition to the wiping of the nozzle forming surface using the cleaning liquid, it is possible to add wiping the nozzle forming surface without using a cleaning liquid.

Wiping Member

Figure 4:
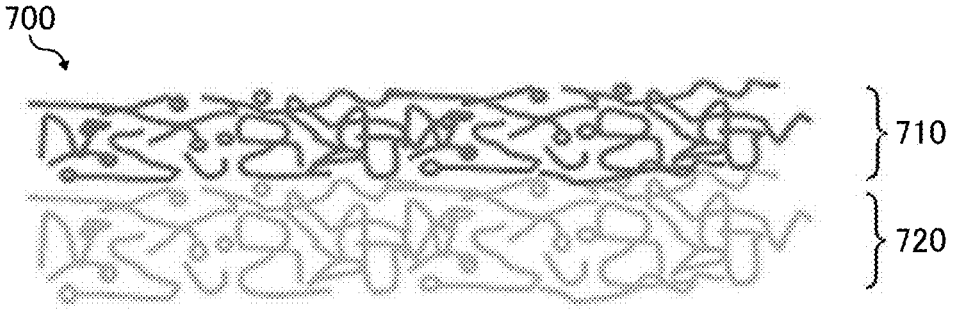
FIG. 4 is a schematic diagram illustrating an example of the cross section of the sheet-like wiping member.

Next, the wiping member will be described with reference to FIG. 4. FIG. 4 is a schematic diagram illustrating an example of the cross section of the wiping member having a sheet-like form. A wiping member 700 illustrated in FIG. 4 is a double-layer non-woven fabric and has a first layer 710 that is brought into contact with the nozzle forming surface to wipe the nozzle forming surface of a liquid discharging head and a second layer 720 (layer other than the first layer) having a rear surface that is not brought into contact with the nozzle forming surface. The wiping member 700 may take a three-layer structure lined with a film to prevent strike through of ink and reinforce the strength of the wiping member or a multi-layer structure having multiple absorbing layers having different absorptivity, which are provided as the second layer or thereafter. That is, the wiping member has at least two layers including a first layer and at least one more layer other than the first layer. When the wiping member includes at least two layers, the cleanliness on the nozzle forming surface of a liquid discharging head can be maintained even for liquid having a high fixability (in particular, liquid containing a large amount of resins).

Examples of materials constituting the wiping member may include, but are not limited to, woven fabric, knitted fabric, and porous materials in addition to non-woven fabric. In particular, it is preferable to use a non-woven fabric because the thickness and porosity can be controlled relatively easily and various types of fibers can be easily mixed. Materials of fibers, such as non-woven fabric, woven fabric, and knitted fabric include, but are not limited to, cotton, hemp, silk, pulp, nylon, vinylon, polyester, polypropylene, polyethylene, rayon, cupra, acrylic, and polylactic acid. Non-woven fabric may be made not only of one type of fiber but also be of mixed plural types of fibers. Examples of the porous materials include, but are not limited to, polyurethane, polyolefin, and PVA. A method of manufacturing a non-woven fabric wiping member will be described. Examples of the method of forming a non-woven fabric include, but are not limited to, wet, dry, spun-bond, melt-blown and flash spinning. Moreover, the non-woven fabric can be bonded by, for example, methods such as spun lace, needle punch, thermal bond, chemical bond, etc. In the spun lace method, jet water stream is sprayed onto accumulated fibers to entangle the fibers due to the pressure, thereby bonding the fibers like a sheet. The needle-punch method forms a non-woven fabric by stabbing a needle with a protrusion called a barb into accumulated fibers several ten times or more to mechanically intertwine the fibers. It is preferable that the wiping member be desirably made of non-woven fabric. The thickness and the porosity of the wiping member can be easily controlled to be within a desired numerical range when the wiping member is formed with non-woven fabric.

Further, when the porosity of the first layer is smaller than the porosity of at least one layer other than the first layer, scraping property for the attached ink is improved and the attached ink wiping property is improved. The porosity is calculated as follows:

$$\text{Porosity}=1-(\text{apparent density})/(\text{true density})$$

Regarding sheet-shaped non-woven fabric, etc., the "true density" is the true density of the fiber forming the sheet, and "apparent density" can be obtained by dividing the basis weight of the sheet-shaped material by thickness, i.e., [basis weight/thickness].

The wiping member has a high scraping property when it has a small porosity. However, when the porosity is small, it is difficult to retain liquid components of ink and cleaning liquid. As a result, cleaning properties may be insufficient for a case of a single layer. Therefore, it is preferable to provide a layer other than the first layer capable of holding the liquid component therein. Although ink or a cleaning liquid is not sufficiently held or absorbed or attached matter is not sufficiently wiped in typical technology, function of holding (absorbing) ink or cleaning liquid and function of wiping off attached matter is separated into a configuration having two or more layers, which makes it possible to enhance the holding ability of ink and a cleaning liquid and wiping property of an attached material. Even when the amount of the cleaning liquid applied varies, the wiping member has a high holding power, so that it is possible to prevent the cleaning liquid at a portion where an excessive amount of the cleaning liquid is applied from overflowing into a nozzle orifice. In addition, for the layers of the wiping member, as described above, when the porosity of the first layer is determined to be smaller than the porosity of at least one of the one or more layers other than the first layer, ability of wiping off attached ink is enhanced.

The porosity of the first layer is preferably from 0.60 to 0.85 and more preferably from 0.75 to 0.80. When the porosity of the first layer is from 0.60 to 0.85, the ability of wiping off the attached ink can be improved and preventing the wiping member from becoming filmy but ameliorating permeability.

The porosity of at least one layer of the one or more layers is preferably from 0.80 to 0.99. When the porosity of the layer other than the first layer is within the above-specified range, absorbency of the liquid and cleaning liquid can be improved. By combining the first layer and the layers other than the first layer, the wiping member can strike a balance between scraping ability of the attached ink and absorbency of the liquid and cleaning liquid, thereby improving wiping ability.

The thickness of the wiping member can be appropriately adjusted according to restrictions on the device configuration and a desired liquid retaining force (liquid absorption force). For example, the thickness is preferably from 0.1 to 3.0 mm.

Cleaning Liquid

The cleaning liquid carried in the wiping device contains the compound represented by Chemical formula 1, the glycol ether compound and other optional components such as other organic solvents, surfactants, water, and other components. The wiping member wipes off this cleaning liquid after the cleaning liquid is directly or indirectly applied to the nozzle forming surface so that viscosity of attached matter formed on the nozzle forming surface decreases, thereby easily removing the attached material. The cleaning liquid for use in the present embodiment is based on the knowledge that, due to the combinational use of the compound represented by Chemical formula 1 and the glycol ether compound, cleaning property is better in comparison with a sole use of each. It is also preferable that the cleaning liquid storage container be filled with the cleaning liquid and mounted on the liquid discharging device.

Compound Represented by Chemical Formula 1

The cleaning liquid contains the compound represented by Chemical formula 1.

Chemical formula 1

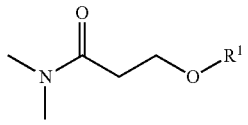

In Chemical formula 1, $R^1$ represents an alkyl group having one to four carbon atoms such as a methyl group, an ethyl group, a propyl group, and a butyl group. Of these, methyl group, ethyl group, and butyl group are preferable and methyl group and t-butyl group are more preferable.

Specific examples of the compound represented by Chemical formula 1 include, but are not limited to, 3-methoxy-N,N-dimethyl propionamide when $R^1$ of Chemical formula 1 is methyl group and 3-butoxy-N,N-dimethyl propionamide when $R^1$ of Chemical formula 1 is butyl group.

It is possible to use a suitably synthesized compound or a product available on the market as the compound.

Specific examples include, but are not limited to, 3-methoxy-N,N-dimethyl propionamide (Equamide™ M100, manufactured by Idemitsu Kosan Co., Ltd.) and 3-butoxy-N,N-dimethyl propionamide (Equamide™ B100, manufactured by Idemitsu Kosan Co., Ltd.).

An example of a method of synthesizing 3-methoxy-N,N-dimethyl propionamide is described next.

19.828 g of N,N-dimethyl acrylamide and 19.868 g of ethanol are loaded and stirred in a separable flask (300 ml) equipped with a stirrer, a thermocouples, and a nitrogen gas introduction tube while introducing nitrogen gas thereinto. Next, 0.338 g of sodium-methoxide is added followed by reaction at 35 degrees C. for four hours. After the reaction, 150 mg of phosphoric acid is added to obtain a uniform solution, which is thereafter left for three hours. The resultant is filtrated to remove precipitate and unreacted matter is removed by an evaporator to synthesize the compound represented by Chemical formula 1.

An example of a method of synthesizing 3-butoxy-N,N-dimethyl propionamide is described next.

19.828 g of N,N-dimethyl acrylamide and 19.868 g of ethanol are loaded and stirred in a separable flask (300 ml) equipped with a stirrer, a thermocouples, and a nitrogen gas introduction tube while introducing nitrogen gas thereinto. Next, 0.338 g of sodium-butoxide is added followed by reaction at 35 degrees C. for four hours. After the reaction, 150 mg of phosphoric acid is added to obtain a uniform solution, which is left for three hours. The resultant is filtrated to remove precipitate and unreacted matter is removed by an evaporator to a synthetic compound.

The proportion of the compound represented by Chemical formula 1 to the total amount of the cleaning liquid is preferably from 20.0 to 50.0 percent by mass and more preferably from 30.0 to 40.0 percent by mass. When the proportion is from 20.0 to 50.0 percent by mass, wiping property for attached matter using a cleaning liquid, discharging stability (discharging reliability) of ink after wiping and mixing stability due to which viscosity does not greatly change when the liquid and the cleaning liquid are mixed can be well-balanced.

Glycol Ether Compound

The glycol ether compound strongly works on the attached matter formed as a result of drying and fixing of liquid such as ink, thereby enhancing wiping property for the attached matter using the cleaning liquid. In a combinational use of the glycol ether compound and the compound represented by Chemical formula 1, wiping property for the attached matter using a cleaning liquid, discharging stability (discharging reliability) of the ink after wiping, and mixing stability due to which viscosity does not greatly change when the liquid and the cleaning liquid are mixed can be well-balanced.

Specific examples of the glycol ether compounds include, but are not limited to, ethylene glycol monobutyl ether, propylene glycol monomethyl ether, propylene glycol monobutyl ether, diethylene glycol monoethyl ether, diethylene glycol monobutyl ether, diethylene glycol methyl ethyl ether, diprpopylene glycol monomethyl ether, dipropylene glycol monoethyl ether, propylene glycol-n-propyl ether, triethylene glycol monometyl ether, triethylene glycol monoethyl ether, triethylene glycol monobutyl ether, tripropylene glycol monomethyl ether, and dialkyl glycol ether compounds represented by the following Chemical formula 2. These can be used alone or in combination. Of these, since attached matter of dried liquid tends to soften and wiping property for the attached matter using a cleaning liquid can be enhanced, dialkyl glycol ether compounds represented by the following Chemical formula 2 is particularly preferable.

Chemical formula 2

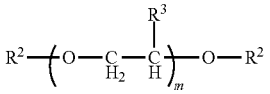

In Chemical formula 2, $R^2$ each, independently represent $C_nH_{2n+1}$ and $R^3$ represents a hydrogen atom or a methyl group. m represents an integer of from 1 to 4 and n represents an integer of from 1 to 4. Regarding $R^2$, "each, independently" means two of $R^2$ existing in Chemical formula 2 can be identical to each other or different from each other as long as $R^2$ satisfies $C_nH_{2n+1}$.

Specific examples of the dialkyl glycol ether compound represented by Chemical formula 2 include, but are not limited to, diethylene glycol dimethyl ether, dietylene glycol diethyl ether, diethylene glycol dibutyl ether, tetraethylene glycol dimethyleter, and tetraethylene glycol diethyl ether.

The proportion of the glycol ether compound to the total amount of the cleaning liquid is preferably from 1.0 to 30.0 percent by mass and more preferably from 10.0 to 20.0 percent by mass. When the proportion is from 1.0 to 30.0 percent by mass, wiping property for attached matter using a cleaning liquid, discharging stability (discharging reliability) of ink after wiping, and mixing stability due to which viscosity does not greatly change when the liquid and the cleaning liquid are mixed can be well-balanced.

Other Organic Solvent

The organic solvent is not particularly limited and can be suitably selected to suit to a particular application. For example, water-soluble organic solvents are usable. The water-soluble organic solvent is not particularly limited and can be suitably selected to suit to a particular application. Examples include, but are not limited to, polyhydric alcohols, nitrogen-containing heterocyclic compounds, amides, amines, sulfur-containing compounds, propylene carbonates, ethylene carbonates, and polyol compounds having eight or more carbon atoms. These can be used alone or in combination.

Specific examples of the polyhydric alcohol include, but are not limited to, ethylene glycol, diethylene glycol, 1,2-propanediol, 1,3-propane diol, 1,2-butanediol, 1,3-butanediol, 1,4-butanediol, 2,3-butanediol, 3-methyl-1,3-butanediol, trethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and petriol.

Specific examples of the nitrogen-containing heterocyclic compound include, but are not limited to, 2-pyrrolidone, N-methyl-2-pyrrolidone, N-hydroxyethyle-2-pyrrolidone, 1,3-dimethyl-2-imidazoline, ε-caprolactam, and γ-butylolactone.

Specific examples of the amine include, but are not limited to, monoethanol amine, diethanol amine, and triethyl amine.

Specific examples of the sulfur-containing compounds include, but are not limited to, dimethyl sulphoxide, sulfolane, and thiodiethanol.

Specific examples of the polyol compound having 8 or more carbon atoms include, but are not limited to, 2-ethyl-1,3-hexanediol and 2,2,4-trimethyl-1,3-pentanediol.

The proportion of the organic solvent to the total amount of the cleaning liquid is preferably from 10.0 to 50.0 percent by mass and more preferably from 20.0 to 30.0 percent by mass.

Surfactant

Polyoxyalkylene surfactants, silicone-based surfactants, fluorochemical surfactants, amphoteric surfactants, nonionic surfactants, and anionic surfactants can be used as the surfactant. Of these, polyoxyalkylene surfactants and silicone-based surfactants are preferable. Polyoxyalkylene surfactants are particularly preferable in terms of wiping property of cleaning liquid for attached matter and storage stability of cleaning liquid. These can be used alone or in combination.

Examples of the polyoxyalkylene surfactant include, but are not limited to, polyoxyethylene distyrenated phenyl ether and polyoxyethylene polyoxypropylene alkyl ether.

Any suitably synthesized polyoxyalkylene surfactant and any product available on the market can be used.

Specific examples of the product available on the market include, but are not limited to, EMULGEN A-60 (polyoxyethylenedistyrenated phenyl ether), EMULGEN LS-106 (polyoxyethylene polyoxypropylene alkyl ether), EMULGEN LS-110 (polyoxyethylene polyoxypropylene alkyl ether) (higher alcohol-based ether-rype nonionic surfactant, all manufactured by Kao Corporation). These can be used alone or in combination.

The silicone-based surfactant has no particular limit and can be suitably selected to suit to a particular application.

Specific examples include, but are not limited to, side-chain-modified polydimethyl siloxane, both distal-end-modified polydimethyl siloxane, one-distal-end-modified polydimethyl siloxane, and side-chain-both-distal-end-modified polydimethyl siloxane. In particular, a polyether-modified silicone-based surfactant having a polyoxyethylene group or a polyoxyethylene polyoxypropylene group is particularly preferable because such a surfactant demonstrates good property as an aqueous surfactant.

It is possible to use a polyether-modified silicone-based surfactant as the silicone-based surfactant. A specific example thereof is a compound in which a polyalkylene oxide structure is introduced into the side chain of the Si site of dimethyl siloxane.

Any suitably synthesized silicone-based surfactant can be used. Products available on the market are also usable. Products available on the market can be obtained from BYK-Chemie GmbH, Shin-Etsu Chemical Co., Ltd., Dow Corning Toray Co., Ltd., NIHON EMULSION Co., Ltd., Kyoeisha Chemical Co., Ltd., etc.

The polyether-modified silicon-based surfactant has no particular limit and can be suitably selected to suit to a particular application. For example, a compound is usable in which the polyalkylene oxide structure represented by the following Chemical formula S-1 is introduced into the side chain of the Si site of dimethyl polysiloxane.

Chemical formula S-1

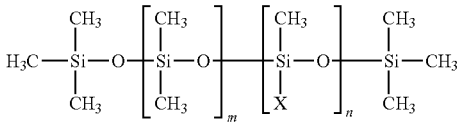

X = —$R(C_2H_4O)_a(C_3H_6O)_bR'$

In Chemical formula S-1, "m", "n", "a", and "b" each, respectively independently represent integers, R represents an alkylene group, and R' represents an alkyl group.

Specific examples of the polyether-modified silicone-based surfactant include, but are not limited to, KF-618, KF-642, and KF-643 (all manufactured by Shin-Etsu Chemical Co., Ltd.), EMALEX-SS-5602 and SS-1906EX (both manufactured by NIHON EMULSION Co., Ltd.), FZ-2105, FZ-2118, FZ-2154, FZ-2161, FZ-2162, FZ-2163, and FZ-2164 (all manufactured by Dow Corning Toray Co., Ltd.), BYK-33 and BYK-387 (both manufactured by BYK Chemie GmbH), and TSF4440, TSF4452, and TSF4453 (all manufactured by Momentive Performance Materials Inc.).

Specific examples of the fluorochemical surfactant include, but are not limited to, perfluoroalkyl sulfonic acid compounds, perfluoroalkyl carboxylic acid compounds, ester compounds of perfluoroalkyl phosphoric acid, adducts of perfluoroalkyl ethylene oxide, and polyoxyalkylene ether polymer compounds having a perfluoroalkyl ether group in its side chain. These are particularly preferable because the fluorochemical surfactant does not easily produce foams.

Specific examples of the perfluoroalkyl sulfonic acid compounds include, but are not limited to, perfluoroalkyl sulfonic acid and salts of perfluoroalkyl sulfonic acid.

Specific examples of the perfluoroalkyl carboxylic acid compounds include, but are not limited to, a perfluoroalkyl carboxylic acid and a salt of perfluoroalkyl carboxylic acid.

Specific examples of the polyoxyalkylene ether polymer compounds having a perfluoroalkyl ether group in its side chain include, but are not limited to, sulfuric acid ester salts of polyoxyalkylene ether polymer having a perfluoroalkyl ether group in its side chain, and salts of polyoxyalkylene ether polymers having a perfluoroalkyl ether group in its side chain. Counter ions of salts in these fluorochemical surfactants are, for example, Li, Na, K, $NH_4$, $NH_3CH_2CH_2OH$, $NH_2(CH_2CH_2OH)_2$, and $NH(CH_2CH_2OH)_3$.

Specific examples of the ampholytic surfactants include, but are not limited to, lauryl aminopropionic acid salts, lauryl dimethyl betaine, stearyl dimethyl betaine, and lauryl dihydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan aliphatic acid esters, polyoxyethylene sorbitan aliphatic acid esters, and adducts of acetylene alcohol with ethylene oxides.

Specific examples of the anionic surfactants include, but are not limited to, polyoxyethylene alkyl ether acetates, dodecyl benzene sulfonates, laurates, and polyoxyethylene alkyl ether sulfates.

The proportion of the surfactant is not particularly limited and can be suitably selected to suit to a particular application. For example, it is preferably from 0.001 to 5 percent by mass, more preferably from 0.05 to 5 percent by mass, and furthermore preferably from 0.1 to 3 percent by mass in terms of storage stability.

The static surface tension of the cleaning liquid is preferably higher than the static surface tension of the liquid such as ink, which is described later by adjusting the type and the amount of surfactants for use in the cleaning liquid. Under the condition that the static surface tension of the cleaning liquid is higher than the static surface tension of the liquid, it is possible to prevent the cleaning liquid from entering the nozzle orifice when the wiping member wipes the nozzle forming surface. Reduction of the cleaning liquid entering nozzle orifices leads to prevention of deterioration of function of the liquid caused by mixture of the liquid and the cleaning liquid in the nozzle orifice. For example, when the liquid is ink, a decrease of image density of an image formed with the ink after wiping can be prevented because the cleaning liquid does not enter a nozzle orifice or mix with the ink.

Water

As the water, for example, pure water and ultra pure water such as deionized water, ultrafiltered water, reverse osmosis water, and distilled water are suitable.

The proportion of the water is not particularly limited and can be suitably selected to suit to a particular application. For example, it is preferably from 20.0 to 80.0 percent by mass and more preferably from 30.0 percent by mass to 60.0 percent by mass to the total amount of the cleaning liquid.

Other Components

The other optional components are not particularly limited and can be suitably selected to suit to a particular application. Examples include, but are not limited to, defoaming agents, preservatives and fungicides, pH regulators, and corrosion inhibitors.

Defoaming Agent

The defoaming agent has no particular limit. For example, silicon-based defoaming agents, polyether-based defoaming agents, and aliphatic acid ester-based defoaming agents are suitable. These can be used alone or in combination. Of these, silicone-based defoaming agents are preferable in terms of the effect of foam breaking.

Preservatives and Fungicides

The preservatives and fungicides are not particularly limited. A specific example is 1,2-benzisothiazoline-3-one.

Corrosion Inhibitor

The corrosion inhibitor has no particular limitation. Specific examples include, but are not limited to, acid sulfites and sodium thiosulfates.

pH Regulator

The pH regulator has no particular limit as long as it can control pH to not lower than 7.

Specific examples include, but are not limited to, amines such as diethanol amine and triethanol amine.

Liquid

The ink, which is an example of the liquid carried in the liquid discharging device, is described below. It is preferable that an ink container be filled with the ink as an example of the liquid and mounted on the liquid ejection device. The liquid is not limited to ink, and may be, for example, a pre-processing liquid to be applied to a recording medium before ink discharging and a post-processing liquid to be applied to an ink-discharged surface of the recording medium after ink discharging.

The ink as an example of the liquid preferably contains an organic solvent and a coloring material and may furthermore contain other optional substances such as water, a resin, and other additives. The ink may be a clear ink containing a resin without containing a color material. If the proportion of a resin contained in the ink is high, adhesiveness between an ink film formed as a result of drying of discharged ink ameliorates, which is preferable, but at the same time, maintaining discharging reliability of the ink is likely to be difficult. However, in embodiments in which the cleaning liquid and the wiping member are used, removing the ink film becomes easy so that adhesiveness between the ink film and the recording medium and maintaining discharging reliability of the ink can be well-balanced.

Organic Solvent

There is no specific limitation to the organic solvent for use in the ink. For example, water-soluble organic solvents can be used. Examples include, but are not limited to, polyhydric alcohols, ethers such as polyhydric alcohol alkyl ethers and polyhydric alcohol aryl ethers, nitrogen-containing heterocyclic compounds, amides, amines, and sulfur-containing compounds.

Specific examples of the water-soluble organic solvent include, but are not limited to: polyhydric alcohols such as ethylene glycol, diethylene glycol, 1,2-propanediol, 1,3-propanediol, 1,2-butanediol, 1,3-butanediol, 1,4-butanediol, 2,3-butanediol, 3-methyl-1,3-butane diol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butane triol, 1,2,3-butanetriol, 2,2,4-trimethyl-1,3-pentanediol, and petriol; polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; polyol aryl ethers such as ethylene glycol monophenyl ether and ethylene glycol monobenzyl ether; nitrogen-containing heterocyclic compounds such as 2-pyrrolidone, N-methyl-2-pyrrolidone, N-hydroxyethyl-2-pyrrolidone, 1,3-dimethyl-2-imidazolidinone, ε-caprolactam, and γ-butyrolactone; amides such as formamide, N-methylformamide, N,N-dimethylformamide, 3-methoxy-N,N-dimethyl propioneamide, and 3-buthoxy-N,N-dimethyl propioneamide; amines such as monoethanolamine, diethanolamine, and triethylamine; sulfur-containing compounds such as dimethyl sulfoxide, sulfolane, and thiodiethanol; propylene carbonate, and ethylene carbonate.

To serve as a humectant and impart a good drying property, it is preferable to use an organic solvent having a boiling point of 250 degrees C. or lower.

Polyol compounds having eight or more carbon atoms and glycol ether compounds are also suitable.

Specific examples of the polyol compounds having eight or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

The polyhydric alcohol compounds having eight or more carbon atoms and glycol ether compounds enhance permeability of ink for paper used as a recording medium.

The proportion of the organic solvent in the ink has no particular limit and can be suitably selected to suit to a particular application.

In terms of drying property and discharging reliability of the ink, the proportion is preferably from 10 to 60 percent by mass and more preferably from 20 to 60 percent by mass.

Coloring Material

The coloring material has no particular limit. For example, pigments and dyes are suitable. As the pigment, inorganic pigments or organic pigments can be used. These can be used alone or in combination. In addition, it is possible to use a mixed crystal.

As the pigments, for example, black pigments, yellow pigments, magenta pigments, cyan pigments, white pigments, green pigments, orange pigments, and gloss pigments and metallic pigments of gold, silver, etc., can be used.

As the inorganic pigments, in addition to titanium oxide, iron oxide, calcium carbonate, barium sulfate, aluminum hydroxide, barium yellow, cadmium red, and chrome yellow, carbon black manufactured by known methods such as contact methods, furnace methods, and thermal methods can be used.

As the organic pigments, it is possible to use azo pigments, polycyclic pigments (phthalocyanine pigments, perylene pigments, perinone pigments, anthraquinone pigments, quinacridone pigments, di oxazine pigments, indigo pigments, thioindigo pigments, isoindolinone pigments, and quinophthalone pigments, etc.), dye chelates (basic dye type chelates, acid dye type chelates, etc.), nitro pigments, nitroso pigments, and aniline black can be used.

Of those pigments, pigments having good affinity with solvents are preferable. Also, hollow resin particles and hollow inorganic particles can be used.

Specific examples of the pigments for black include, but are not limited to, carbon black (C.I. Pigment Black 7) such as furnace black, lamp black, acetylene black, and channel black, metals such as copper, iron (C.I. Pigment Black 11), and titanium oxide, and organic pigments such as aniline black (C.I. Pigment Black 1).

Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red (PR) 1, 2, 3, 5, 17, 22, 23, 31, 38, 48:2, 48:2{Permanent Red 2B(Ca)}, 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 166, 168, 170, 172, 177, 178, 179, 184, 185, 190, 193, 202, 207, 208, 209, 213, 219, 224, 254, and 264; C.I. Pigment Violet 1 (Rhodamine Lake), 3, 5:1, 16, 19, 23, and 38; C.I. Pigment Blue 1, 2, 15 (Phthalocyanine Blue), 15:1, 15:2, 15:3, 15:4, (Phthalocyanine Blue), 16, 17:1, 56, 60, and 63; C.I. Pigment Green 1, 4, 7, 8, 10, 17, 18, and 36.

The dye is not particularly limited and includes, for example, acidic dyes, direct dyes, reactive dyes, basic dyes. These can be used alone or in combination.

Specific examples of the dye include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the coloring material in the ink is preferably from 0.1 to 15 percent by mass and more preferably from 1 to 10 percent by mass in terms of enhancement of image density, fixability, and discharging stability.

To obtain an ink by pigment dispersion, for example, a hydrophilic functional group is introduced into a pigment to prepare a self-dispersible pigment, the surface of a pigment is coated with a resin followed by dispersion, or a dispersant is used to disperse a pigment.

To prepare a self-dispersible pigment by introducing a hydrophilic functional group into a pigment, for example, it is possible to add a functional group such as a sulfone group and a carboxyl group to the pigment (e.g., carbon) to disperse the pigment in water.

To coat the surface of a pigment with a resin, the pigment is encapsulated by microcapsules to make the pigment dispersible in water. This can be referred to as a resin-coated pigment. In this case, all the pigments to be added to ink are not necessarily entirely coated with a resin. Pigments uncoated or partially uncoated with a resin may be dispersed in the ink.

In a method of using a dispersant to disperse a pigment, for example, a known dispersant having a small molecular weight or a large molecular weight, which is represented by a surfactant, is used to disperse the pigment in ink. As the dispersant, it is possible to use, for example, an anionic surfactant, a cationic surfactant, a nonionic surfactant, an amphoteric surfactant, etc. depending on a pigment. Also, a nonionic surfactant (RT-100, manufactured by TAKEMOTO OIL & FAT CO., LTD.) and a formalin condensate of naphthalene sodium sulfonate are suitable as the dispersant. Those can be used alone or in combination.

Water

The proportion of water in the ink is not particularly limited and can be suitably selected to suit to a particular application. For example, in terms of the drying property and discharging reliability of the ink, the proportion is preferably from 10 to 90 percent by mass and more preferably from 20 to 60 percent by mass.

Resin

The type of the resin contained in the ink has no particular limit and can be suitably selected to suit to a particular application. Examples include, but are not limited to, urethane resins, polyester resins, acrylic-based resins, vinyl acetate-based resins, styrene-based resins, butadiene-based resins, styrene-butadiene-based resins, vinylchloride-based resins, acrylic styrene-based resins, and acrylic silicone-based resins. These can be used alone or in combination. Of these, urethane resins are preferable. It is preferable to use the resin as resin particle. It is possible to mix a resin emulsion in which such resin particles are dispersed in water as a dispersion medium with materials such as a coloring material and an organic solvent to obtain an ink.

The volume average particle diameter of the resin particle is not particularly limited and can be suitably selected to suit to a particular application. The volume average particle diameter is preferably from 10 to 1,000 nm, more preferably from 10 to 200 nm, and particularly preferably from 10 to 100 nm to obtain good fixability and image robustness. The volume average particle diameter can be measured by using, for example, a particle size analyzer (Nanotrac Wave-UT151, manufactured by MicrotracBEL Corp.).

The proportion of the resin particle is not particularly limited and can be suitably selected to suit to a particular application. In terms of fixability and storage stability of ink, it is preferably from 1 to 30 percent by mass and more preferably from 5 to 20 percent by mass to the total amount of the ink.

Additive

The ink may further optionally include a surfactant, a defoaming agent, a preservative and fungicide, a corrosion inhibitor, a pH regulator, etc. The same agents as for the cleaning liquid can be used.

Property of Ink

Properties of the ink are not particularly limited and can be suitably selected to suit to a particular application. For example, viscosity, pH, etc, are preferable in the following ranges.

Viscosity of the ink at 25 degrees C. is preferably from 5 to 30 mPa·s, and more preferably from 5 to 25 mPa·s. Viscosity can be measured by, for example, a rotatory viscometer (RE-80L, manufactured by TOKI SANGYO CO. LTD.). The measuring conditions are as follows:

Standard cone rotor (1° 34'×R24)

Sample liquid amount: 1.2 mL

Rotational frequency: 50 rotations per minute (rpm)

25 degrees C.

Measuring time: three minutes.

pH of the ink is preferably from 7 to 12 and more preferably from 8 to 11 in terms of prevention of corrosion of metal material in contact with liquid.

Recording Medium

The recording medium to which the liquid is applied is not particularly limited. Plain paper, gloss paper, special paper, cloth, etc. are usable. Also, good images can be formed on a non-permeable substrate. To the recording medium, liquid can be at least temporarily attached.

The non-permeable substrate has a surface with low moisture permeability and low absorbency and includes a material having myriad of hollow spaces inside but not open to the outside. To be more quantitative, the substrate has a water-absorption amount of 10 $mL/m^2$ or less within 30 $msec^{1/2}$ of the contact of the ink according to Bristow method.

For example, plastic films such as vinyl chloride resin film, polyethylene terephthalate (PET) film, polypropylene film, polyethylene film, and polycarbonate film are suitably used as the non-permeable substrate.

The recording media are not limited to articles used as typical recording media. It is suitable to use building materials such as wall paper, floor material, and tiles, cloth for apparel such as T-shirts, textile, and leather as the recording medium. In addition, the configuration of the paths through which the recording medium is conveyed can be adjusted to use ceramics, glass, metal, etc.

Having generally described preferred embodiments of this disclosure, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but is not limited thereto. The adjustment of the white ink and the cleaning liquid of the following Examples and respective evaluations were conducted at 25 degrees C. and 60 percent humidity unless otherwise specified.

Preparation of White Pigment Dispersion 5.0 g of polyoxyethylene styrenated phenyl ether (NOIGEN EA-177, solid mass: 100 percent by mass, manufactured by DKS Co. Ltd.) was dissolved in 200.0 g of highly pure water in a beaker. Thereafter, 50.0 g of an organic white pigment particle (Shigenox OWP, manufactured by "Hakkoru Chemical") as alkylene bismelamine compound was added thereto. The resultant was dispersed until no block was observed while stirring with an excel auto homogenizer (manufactured by NISSEI Corporation) at 5,000 rpm for 30 minutes and the rotation frequency was gradually increased until 10,000 rpm and stirred at 10,000 rpm for 30 minutes.

While cooling the thus-obtained organic white pigment particle liquid dispersion with water, the liquid dispersion was treated with an ultrasonic homogenizer (US-300T, diameter of tip of 26 mm, manufactured by NIS SEI Corporation) at 200 μA for one hour.

The thus-obtained organic white pigment particle liquid dispersion was subject to dispersion with a DYNO-Mil multi-labo type disperser (manufactured by Shinmaru Enterprises Corporation) using a zirconia bead having a diameter of 2 mm as media with a bead filling ratio of 70 percent by volume, a peripheral speed of a stirring wing of 8 m/s and batch treatment for 30 minutes. Thereafter, using a nanomaker (manufactured by Advanced Nano Technology Co., Ltd.), the resultant was subject to dispersion at a pressure of 100 Mpa with 20 passes.

Next, the resultant was filtered with a membrane filter (cellulose acetate film) having an average pore diameter of 5 μm to obtain an organic white pigment particle dispersion in which the organic pigment particle had a proportion of 19.6 percent by mass.

Preparation of White Ink

Next, 15.0 percent by mass 1,3-butanediol, 15.0 percent by mass 1,2-propane diol, 6.7 percent by mass (in solid mass conversion) acrylic resin emulsion (VONCOAT R-3380-E, solid mass of 45 percent by mass, manufactured by DIC Corporation), and 1.0 percent by mass fluorochemical surfactant (Zonyl™, FSO-100, manufactured by E.I. du Pont de Nemours and Company) were admixed and stirred. Thereafter, deionized water was added as a balance to make the thus-obtained organic white pigment particle dispersion 20.0 percent by mass and the total 100 percent by mass followed by stirring for one hour.

Next, using a polypropylene filter having an average pore diameter of 1.5 μm under a pressure, the resultant was filtrated to remove coarse particles, thereby adjusting white ink. The components of the white ink were shown in Table 1. The content of the acrylic resin emulsion in Table 1 was represented in solid mass conversion.

TABLE 1

| Component (percent by mass) | | White Ink |
|---|---|---|
| Organic solvent | 1:3-Butane diol | 15.0 |
| | 1,2-propane diol | 15.0 |
| Resin | Acrylic resin emulsion | 6.7 |
| Pigment dispersion | Organic white pigment particle dispersion | 20.0 |
| Surfactant | FSO-100 | 1.0 |
| Water | Deionized water | Balance |
| Total (percent by mass) | | 100 |

The trade names and the manufacturing companies of the ingredients shown in Table 1 are as follows:

1,3-butane diol: manufactured by Tokyo Chemical Industry Co. Ltd.

1,2-propane diol, manufactured by Mitsui Chemicals, Inc.

Acrylic resin emulsion (VONCOAT R-3380-E, solid mass of 45 percent by mass, manufactured by DIC Corporation)

Surfactant: ZONYL™ FSO-100, manufactured by E. I. du Pont de Nemours and Company Adjustment of Cleaning Liquid Preparation of Cleaning Liquid 1

The cleaning liquids 1 to 10 having the formulation in an amount (unit of value in percent by mass) shown in the following Tables 2 and 3 were adjusted.

TABLE 2

| Component (percent by mass) | | Cleaning liquid 1 | 2 | 3 | 4 | 5 |
|---|---|---|---|---|---|---|
| Compound represented by Chemical formula 1 | $R^1$ = methyl group | 20.0 | 30.0 | 40.0 | 50.0 | 40.0 |
| | $R^1$ = butyl group | | | | | |
| Glycolether compound | Diethylene glycol monobutyl ether | | | | | |
| | Triethylene glycol monoethyl ether | | | | | |
| | Diethylene glycol diethyl ether | 20.0 | 30.0 | 20.0 | 10.0 | 5.0 |
| Surfactant | LS-106 | 1.0 | | 1.0 | | 1.0 |
| | LS-110 | | 1.0 | | 1.0 | |
| Water | Pure water | 59.0 | 39.0 | 39.0 | 39.0 | 54.0 |
| Total (percent by mass) | | 100 | 100 | 100 | 100 | 100 |

TABLE 3

| Component (percent by mass) | | Cleaning liquid 6 | 7 | 8 | 9 | 10 |
|---|---|---|---|---|---|---|
| Compound represented by Chemical formula 1 | $R^1$ = methyl group | 30.0 | 40.0 | | | 50.0 |
| | $R^1$ = butyl group | | | 20.0 | | |
| Glycolether compound | Diethylene glycol monobutyl ether | | | | 10.0 | |
| | Triethylene glycol monoethyl ether | | 20.0 | | | |
| | Diethylene glycol diethyl ether | 35.0 | | 30.0 | | |
| Surfactant | LS-106 | | 1.0 | | | |
| | LS-110 | 1.0 | | 1.0 | 1.0 | 1.0 |
| Water | Pure water | 34.0 | 39.0 | 49.0 | 89.0 | 49.0 |
| Total (percent by mass) | | 100 | 100 | 100 | 100 | 100 |

The trade names and the manufacturing companies of the ingredients shown in Tables 2 and 3 are as follows:

Compound represented by Chemical formula 1 in which $R^1$ was methyl group (3-methoxy-N,N-dimethyl propionamide, trade name Equamide™ M100, manufactured by Idemitsu Kosan Co., Ltd.)

Compound represented by Chemical formula 1 in which $R^1$ was butyl group (3-butoxy-N,N-dimethyl propionamide, trade name Equamide™ B100, manufactured by Idemitsu Kosan Co., Ltd.)

Diethylene glycol monobutyl ether (manufactured by Tokyo Chemical Industry Co. Ltd.)

Triethylene glycol monoehtyl ether (manufactured by Tokyo Chemical Industry Co. Ltd.)

Diethylene glycol diehtyl ether (manufactured by Tokyo Chemical Industry Co. Ltd.)

EMULGEN LS-106 (polyoxyethylene polyoxypropylene alkyl ether, higher alcohol-based ether-type nonionic surfactant, manufactured by Kao Corporation)

EMULGEN LS-110 (polyoxyethylene polyoxypropylene alkyl ether, higher alcohol-based ether-type nonionic surfactant, manufactured by Kao Corporation)

Manufacturing of Wiping Member

A sheet-like non-woven fabric made of the material shown in Table 4 below was prepared and the non-woven fabric was pasted as the first layer and the second layer were to manufacture a wiping member. Note that the wiping member 7 represents a single layer structure.

TABLE 4

| | Porosity | | Used fiber | | Thickness | |
|---|---|---|---|---|---|---|
| Wiping member | First layer | Second layer | First layer | Second layer | First layer | Second layer |
| 1 | 0.80 | 0.99 | Polyester | Rayon | 0.05 | 0.20 |
| 2 | 0.75 | 0.90 | Polyester | Rayon | 0.06 | 0.25 |
| 3 | 0.85 | 0.99 | Polyester | Rayon | 0.05 | 0.30 |
| 4 | 0.55 | 0.90 | Polyester | Rayon | 0.06 | 0.25 |
| 5 | 0.88 | 0.90 | Polyester | Rayon | 0.06 | 0.25 |
| 6 | 0.85 | 0.75 | Polyester | Rayon | 0.06 | 0.25 |
| 7 | 0.60 | — | Polyester | — | 0.06 | — |

Next, using the produced ink, the cleaning liquid, and the wiping member, penetration of the cleaning liquid into a nozzle orifice, discharging reliability, mixing stability of the liquid and the cleaning liquid, and wiping property for the attached matter were evaluated.

Penetration of Cleaning Liquid Into Nozzle Orifice

The image forming discharging device illustrated in FIG. 1 was filled with the white ink and conducted printing for 15 minutes. Thereafter, using the wiping device illustrated in FIG. 3, the nozzle forming surface of the liquid discharging head was wiped with the wiping member shown in Table 5 to which 20 μl of the cleaning liquid shown in Table 5 was applied with a pressing force of 2 N and a wiping speed of 50 mm/s. Immediately thereafter, 500 droplets were jetted from the nozzle onto a recording medium (super fine paper, manufactured by Seiko Epson Corporation) to observe the density of the dots. The number of dots (number of droplets) was counted until the dot density became the same as before wiping the nozzle forming surface of the liquid discharging head and the penetration of the cleaning liquid into the nozzle orifice was evaluated according to the following evaluation criteria. Note that as the number of dots decreases, penetration of the cleaning liquid into a nozzle orifice can be prevented, i.e., a decrease of image density can be reduced.

Evaluation Criteria

A: number of dots is less than 10

B: Number of dots is from 10 to less than 30

C: Number of dots is 30 or more

Discharging Reliability

The image forming and discharging device illustrated in FIG. 1 having an inkjet head (MH5440, manufactured by Ricoh Co., Ltd.) was filled with a white ink and continuously discharged the white ink for 45 minutes. 30 minutes after ceasing the discharging, using the wiping device illustrated in FIG. 3, the nozzle forming surface of the liquid discharging head was wiped with the wiping member shown in Table 5 to which 50 μl of the cleaning liquid shown in Table 5 was applied with a pressing force of 2 N and a wiping speed of 50 mm/s. Thereafter, the white ink was discharged again to evaluate discharging reliability according to the following evaluation criteria.

Evaluation Criteria

A: No discharging disturbance or no non-discharging occurred at all

B: Discharging disturbance and non-discharging occurred at 5 or less nozzles

C: Discharging disturbance and non-discharging occurred at more than 5 nozzles

Mixing Stability of Liquid and Cleaning Liquid 2 g of the white ink and 18 g of the cleaning liquid were loaded in 30 mL glass bottle (LABORAN Screw Tube Bottle No. 6, manufactured by AS ONE Corporation.) and mixed and stirred. Whether the pigment precipitated after a one-week storage of the mixture at 50 degrees C. was visually confirmed and the change ratio of viscosity of the liquid mixture before and after the storage was measured according to the following relationship and evaluated according to the following evaluation criteria. The viscosity was measured by, for example, a viscometer (RE-80L, manufactured by TOKT SANGYO CO., LTD.). The rotational frequency at the time of viscosity measuring was controlled to be constant in the torque range of from 40 to 80 percent.

Change ratio of viscosity (%)=(Viscosity of liquid mixture after storage−Viscosity of liquid mixture before storage)/(Viscosity of liquid mixture before storage)×100

Evaluation Criteria

A. Precipitation of pigment was not observed and change ratio of viscosity was greater than −5 to less than 5 percent B: Precipitation of pigment was not observed but change ratio of viscosity was −5 percent or less or 5 percent or more C: Precipitation of pigment was confirmed Wiping Property for Attached Matter The white ink was applied onto a SUS plate with a wire bar having a diameter of 0.3 mm and thereafter dried at 50 degrees C. for 24 hours using a dryer to form an ink film having an average thickness of 15 μm. Using the wiping device illustrated in FIG. 3, the SUS plate on which the ink film was formed was wiped by the wiping member shown in Table 5 to which 20 μl of the cleaning liquid shown in Table 5 was applied with a pressing force of 3 N and a wiping speed of 50 mm/s.

The number of wiping required until the ink film on the SUS plate could not be visually observed was counted. Note that the less the number of wiping, the more excellent the wiping property, i.e., cleanliness of the nozzle forming surface can be maintained.

Evaluation Criteria

A: Ink film on SUS plate was removed by wiping five times or less

B: Ink film on SUS plate was removed by wiping six or seven times

C: Ink film on SUS plate was removed by wiping eight to ten times

D: Ink film remained on SUS plate after wiping more than ten times

TABLE 5

| | Wiping member | Cleaning liquid | Evaluation result: Penetration of cleaning liquid | Discharging reliability | Mixing stability | Wiping property of attached matter |
|---|---|---|---|---|---|---|
| Example 1 | 1 | 1 | A | A | A | B |
| Example 2 | 2 | 2 | A | A | A | B |
| Example 3 | 1 | 3 | A | A | A | B |
| Example 4 | 2 | 4 | A | A | A | B |
| Example 5 | 1 | 5 | A | A | A | C |
| Example 6 | 2 | 6 | B | A | A | B |
| Example 7 | 1 | 7 | A | A | B | C |
| Example 8 | 3 | 8 | A | A | A | B |
| Example 9 | 4 | 1 | A | A | A | C |
| Example 10 | 5 | 1 | A | A | A | C |
| Example 11 | 6 | 1 | A | A | A | C |
| Comparative Example 1 | 7 | 1 | B | A | A | D |
| Comparative Example 2 | 1 | 9 | A | C | C | D |
| Comparative Example 3 | 1 | 10 | A | C | A | D |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A wiping device comprising:

a wiping member configured to wipe a nozzle forming surface of a liquid discharging head that discharges a liquid from a nozzle, the wiping member having a first layer configured to be brought into contact with the nozzle forming surface and at least one more layer, and a cleaning liquid that is applied to the nozzle forming surface, the cleaning liquid comprising a compound represented by the following Chemical formula 1 and a glycol ether compound, Chemical formula 1

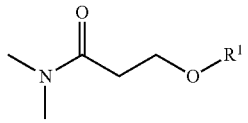

where $R^1$ represents an alkyl group having one to four carbon atoms.

2. The wiping device according to claim 1, wherein the glycol ether compound is represented by the following Chemical formula 2, Chemical formula 2

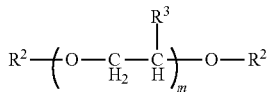

where $R^2$ represents $C_nR_{n+1}$ and $R^3$ represents a hydrogen atom or a methyl group, m represents an integer of from 1 to 4 and n represents an integer of from 1 to 4.

3. The wiping device according to claim 1, wherein a proportion of the glycol ether compound to the cleaning liquid is from 1.0 to 30.0 percent by mass.

4. The wiping device according to claim 1, wherein the first layer has a porosity less than a porosity of at least one layer of the at least one more layer.

5. The wiping device according to claim 1, wherein a porosity of the first layer is from 0.60 to 0.85.

6. The wiping device according to claim 1, further comprising a cleaning liquid applying device configured to apply the cleaning liquid to the wiping member.

7. A liquid discharging device comprising:

a liquid discharging head including a nozzle and having a nozzle forming surface, the liquid discharging head being configured to discharge a liquid from the nozzle;

a wiping member configured to wipe the nozzle forming surface; and a cleaning liquid that is applied to the nozzle forming surface, the cleaning liquid comprising a compound represented by the following Chemical formula 1 and a glycol ether compound, wherein the wiping member has a first layer configured to be brought into contact with the nozzle forming surface and at least one more layer, Chemical formula 1

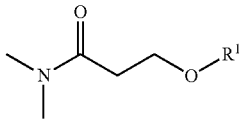

where $R^1$ represents an alkyl group having one to four carbon atoms.

8. The liquid discharging device according to claim 7, wherein the liquid comprises a coloring material and an organic solvent.

9. The liquid discharging device according to claim 7, wherein the liquid comprises a resin and no coloring material.

10. A wiping method comprising:

applying a cleaning liquid to a nozzle forming surface of a liquid discharging head that discharges a liquid from a nozzle; and wiping the nozzle forming surface with a wiping member, wherein the wiping member has a first layer that is brought into contact with the nozzle forming surface and at least one more layer, wherein the cleaning liquid comprises a compound represented by the following Chemical formula 1 and a glycol ether compound, Chemical formula 1

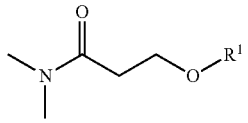

where $R^1$ represents an alkyl group having one to four carbon atoms.

11. The wiping method according to claim 10, wherein the glycol ether compound is represented by the following Chemical formula 2, Chemical formula 2

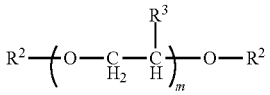

where $R^2$ each, independently represent $C_nH_{2n+1}$ and $R^3$ represents a hydrogen atom or a methyl group, m represents an integer of from 1 to 4 and n represents an integer of from 1 to 4.

12. The wiping method according to claim 10, wherein a proportion of the glycol ether compound to the cleaning liquid is from 1.0 to 30.0 percent by mass.

* * * * *